US012509752B2

(12) United States Patent
Fujimura et al.

(10) Patent No.: US 12,509,752 B2
(45) Date of Patent: Dec. 30, 2025

(54) DUAL-PHASE STAINLESS STEEL AND DUAL-PHASE STAINLESS STEEL SEAMLESS PIPE

(71) Applicant: JFE Steel Corporation, Tokyo (JP)

(72) Inventors: Kazuki Fujimura, Tokyo (JP); Shunsuke Sasaki, Tokyo (JP); Masao Yuga, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 460 days.

(21) Appl. No.: 17/923,049

(22) PCT Filed: May 11, 2021

(86) PCT No.: PCT/JP2021/017934
§ 371 (c)(1),
(2) Date: Nov. 3, 2022

(87) PCT Pub. No.: WO2021/246118
PCT Pub. Date: Dec. 9, 2021

(65) Prior Publication Data

US 2023/0151469 A1 May 18, 2023

(30) Foreign Application Priority Data

Jun. 2, 2020 (JP) ..... 2020-095917

(51) Int. Cl.

| | |
|---|---|
| ***C22C 38/54*** | (2006.01) |
| ***C21D 7/10*** | (2006.01) |
| ***C21D 9/08*** | (2006.01) |
| ***C22C 38/00*** | (2006.01) |
| ***C22C 38/02*** | (2006.01) |
| ***C22C 38/06*** | (2006.01) |
| ***C22C 38/44*** | (2006.01) |

(52) U.S. Cl.
CPC ..... *C22C 38/54* (2013.01); *C21D 7/10* (2013.01); *C21D 9/08* (2013.01); *C22C 38/001* (2013.01); *C22C 38/02* (2013.01); *C22C 38/06* (2013.01); *C22C 38/44* (2013.01); *C21D 2211/001* (2013.01); *C21D 2211/005* (2013.01)

(58) Field of Classification Search
None
See application file for complete search history.

(56) References Cited

U.S. PATENT DOCUMENTS

| | | | | |
|---|---|---|---|---|
| 5,298,093 | A | 3/1994 | Okamoto | |
| 2015/0078953 | A1* | 3/2015 | Otomo | C21D 6/004 420/67 |

FOREIGN PATENT DOCUMENTS

| | | | | |
|---|---|---|---|---|
| CN | 109642282 | A | | 4/2019 |
| CN | 110168124 | A | | 8/2019 |
| EP | 1995341 | A1 | | 11/2008 |
| EP | 2865777 | A1 | | 4/2015 |
| EP | 2918697 | A1 | | 9/2015 |
| EP | 3456852 | A1 | | 3/2019 |
| EP | 3508596 | A1 | | 7/2019 |
| EP | 3561131 | A1 | | 10/2019 |
| EP | 3569725 | A1 | | 11/2019 |
| JP | 03291358 | A | | 12/1991 |
| JP | 05132741 | A | | 5/1993 |
| JP | 08170153 | A | | 7/1996 |
| JP | 2005036313 | A | | 2/2005 |
| JP | 2012149317 | A | | 8/2012 |
| JP | 2014074209 | A | * | 4/2014 |
| JP | 2015059247 | A | | 3/2015 |
| JP | 2016003377 | A | * | 1/2016 |
| RU | 2599936 | C2 | | 10/2016 |
| RU | 2649919 | C2 | | 4/2018 |
| RU | 2698233 | C1 | | 8/2019 |
| RU | 2716438 | C1 | | 3/2020 |
| WO | 2005014872 | A1 | | 2/2005 |
| WO | 2016079920 | A1 | | 5/2016 |

OTHER PUBLICATIONS

Chinese Office Action with Search Report for Chinese Application No. 202180034296.7, dated Apr. 22, 2023, 12 pages.
Russian Office Action for Russian Application No. 2022128506, dated Mar. 16, 2023 with translation, 14 pages.
Extended European Search Report for European Application No. 21818164.2, dated Sep. 21, 2023, 7 pages.
International Search Report and Written Opinion for International Application No. PCT/JP2021/017934, dated Jul. 20, 2021, 5 pages.

* cited by examiner

*Primary Examiner* — Jenny R Wu
(74) *Attorney, Agent, or Firm* — Buchanan Ingersoll & Rooney PC

(57) ABSTRACT

A dual-phase stainless steel or dual-phase stainless steel seamless pipe has a certain composition, the dual-phase stainless steel or dual-phase stainless steel seamless pipe having a microstructure containing 20 to 70% austenitic phase and 30 to 80% ferritic phase by volume, the dual-phase stainless steel or dual-phase stainless steel seamless pipe having a yield strength, YS, of 448 MPa or more, and containing oxide inclusions of which oxide inclusions having an average particle diameter of 1 μm or more have a number density of 15/mm$^2$ or less, and at most 50 mass % of the oxide inclusions having an average particle diameter of 1 μm or more are oxide inclusions containing aluminum.

4 Claims, No Drawings

DUAL-PHASE STAINLESS STEEL AND DUAL-PHASE STAINLESS STEEL SEAMLESS PIPE

CROSS REFERENCE TO RELATED APPLICATIONS

This is the U.S. National Phase application of PCT/JP2021/017934, filed May 11, 2021 which claims priority to Japanese Patent Application No. 2020-095917, filed Jun. 2, 2020, the disclosures of these applications being incorporated herein by reference in their entireties for all purposes.

FIELD OF THE INVENTION

The present invention relates to a dual-phase stainless steel and dual-phase stainless steel seamless pipe having desirable corrosion resistance, high strength, and high toughness, suited for use as oil country tubular goods. Particularly, aspects of the invention relate to a dual-phase stainless steel and dual-phase stainless steel seamless pipe for use as steel pipes for oil country tubular goods.

BACKGROUND OF THE INVENTION

Increasing crude oil prices and an expected shortage of petroleum resources in the near future have prompted active development of oil fields and gas fields that were unthinkable in the past, for example, such as deep oil fields, and oil fields and gas fields of a severe corrosive environment containing hydrogen sulfide and other corrosive chemicals, or a sour environment as it is also called. Such oil fields and gas fields are usually very deep, and are found in a high-temperature atmosphere of a severe corrosive environment containing $CO_2$, $Cl^-$, and $H_2S$. Steel pipes for oil country tubular goods to be used in such environments need to have desirable strength and toughness, and desirable corrosion resistance (carbon dioxide gas corrosion resistance, sulfide stress corrosion cracking resistance, and sulfide stress cracking resistance).

Against this backdrop, a dual-phase stainless steel is available as a steel for steel pipes used for oil country tubular goods. A dual-phase stainless steel has desirable strength characteristics. However, a dual-phase stainless steel needs to have improved corrosion resistance if it were to be used in a severe corrosive environment containing large amounts of hydrogen sulfide, carbon dioxide gas, and chloride ions, such as in today's deep oil wells.

In this connection, for example, PTL 1 discloses a dual-phase stainless steel having desirable corrosion resistance with a PREW number of 40 or more achieved by controlling Cr, Mo, N, and W contents.

PTL 2 discloses a dual-phase stainless steel having desirable corrosion resistance and hot workability achieved by controlling contents of elements such as B and Ta, in addition to Cr, Mo, W, and N contents.

NPL 1 experimentally demonstrates that MnS inclusions in stainless steel create an initiation point of localized corrosion (pitting corrosion).

PTL 3 discloses a dual-phase stainless steel having a reduced S content of 3 ppm or less by weight with the use of a CaO crucible and a $CaO—CaF_2—Al_2O_3$-base slag in a vacuum melting furnace, in order to reduce sulfide inclusions in steel, which are harmful to hot workability and corrosion resistance.

PTL 4 discloses a technique for controlling oxide inclusions, which become an initiation point of pitting corrosion.

Specifically, PTL 4 discloses a dual-phase stainless steel having a controlled total Ca and Mg content and a controlled S content in oxide inclusions, and that adjusts the form and density of inclusions in the steel. By noting that Al oxides become an initiation point of localized corrosion when the amounts of Ca, Mg, and S in these insoluble oxides exceed certain levels, PTL 4 attempts to reduce generation of localized corrosion by controlling the size and number of such inclusions in the dual-phase stainless steel with an appropriate combination of a slag basicity in a reduction process, a killing temperature and a killing time in a ladle, and a total work ratio after casting.

PATENT LITERATURE

PTL 1: JP-A-5-132741
PTL 2: JP-A-8-170153
PTL 3: JP-A-3-291358
PTL 4: WO2005/014872

NON PATENT LITERATURE

NPL 1: Izumi Muto et al., Ferrum, Vol. 17(2012), No. 12, 858-863

SUMMARY OF THE INVENTION

As discussed above, the recent active development of oil fields and gas fields of severe corrosive environments has created a demand for a steel pipe for oil country tubular goods having high strength, high toughness, and desirable corrosion resistance. Here, "desirable corrosion resistance" means having desirable carbon dioxide gas corrosion resistance under a high temperature of 200° C., and, additionally, desirable sulfide stress corrosion cracking resistance (SCC resistance) under a low temperature of 80° C., and desirable sulfide stress cracking resistance (SSC resistance) at an ordinary temperature of 25° C., particularly in a severe corrosive environment containing $CO_2$, $Cl^-$, and $H_2S$.

However, the steels described in PTL 1 to PTL 4 do not fully take into consideration low-temperature sulfide stress corrosion cracking resistance at 80° C., and ordinary-temperature sulfide stress cracking resistance at 25° C.

In light of the problems of related art, an object according to aspects of the present invention is to provide a dual-phase stainless steel and dual-phase stainless steel seamless pipe having high strength, high toughness, and desirable corrosion resistance.

Here, "desirable corrosion resistance" refers to having desirable carbon dioxide gas corrosion resistance, desirable sulfide stress corrosion cracking resistance (SCC resistance), and desirable sulfide stress cracking resistance (SSC resistance) even in severe corrosive environments such as above. A steel pipe obtained from such a dual-phase stainless steel can suitably be used in a severe environment such as in an oil well or gas well producing crude oil and natural gas.

As used herein, "high strength" means a yield strength, YS, of 65 ksi (448 MPa) or more, preferably 95 ksi (655 MPa) or more.

As used herein, "high toughness" means having low-temperature toughness, specifically, an absorption energy $vE_{-10}$ at −10° C. of 40 J or more in a Charpy impact test.

As used herein, "desirable carbon dioxide gas corrosion resistance" means that a test specimen immersed in a test solution (a 20 mass % NaCl aqueous solution; a liquid temperature of 200° C.; an atmosphere of 3.0 MPa $CO_2$ gas) kept in an autoclave has a corrosion rate of 0.125 mm/y or less after 336 hours in the solution, and that the test specimen after the corrosion test does not have pitting corrosion.

As used herein, "desirable sulfide stress corrosion cracking resistance (SCC resistance)" means that a test specimen immersed in a test solution (a 10 mass % NaCl aqueous solution; a liquid temperature of 80° C.; an atmosphere of 2 MPa $CO_2$ gas and 35 kPa $H_2S$) kept in an autoclave has no cracks and no pitting corrosion even when kept in the solution for 720 hours under an applied stress 100% of the yield stress.

As used herein, "desirable sulfide stress cracking resistance (SSC resistance)" means that a test specimen immersed in a test solution held in a test cell (a 20 mass % NaCl aqueous solution; a liquid temperature of 25° C.; an atmosphere of 0.07 MPa $CO_2$ gas and 0.03 MPa $H_2S$) having an adjusted pH of 3.5 by addition of acetic acid and sodium acetate has no cracks and no pitting corrosion even when kept in the solution for 720 hours under an applied stress 90% of the yield stress.

In order to achieve the foregoing object, the present inventors conducted intensive studies of a dual-phase stainless steel with regard to the influence of inclusions on sulfide stress corrosion cracking resistance. The studies led to the following findings.

1) Despite being an oxide, which becomes an initiation point of pitting corrosion, inclusions of primarily MgO render themselves harmless by dissolving while the steel is being immersed in a solution.
2) In inclusions of primarily $Al_2O_3$, corrosion occurs around the inclusions as a result of a reaction that takes place with $Al_2O_3$ serving as a cathode and the surrounding matrix serving as an anode.
3) Sulfide stress corrosion cracking resistance improves when inclusions of primarily $Al_2O_3$ have a low number-density, particularly when oxide inclusions having an average particle diameter of 1 μm or more have a number density of 15/mm$^2$ or less and when the proportion of Al-containing oxide inclusions in these oxide inclusions are 50% or less.

Aspects of the present invention were completed after further studies based on these findings, and are as follows.

[1] A dual-phase stainless steel having a composition that includes, in mass %, C: 0.002 to 0.03%, Si: 0.05 to 1.0%, Mn: 0.10 to 1.5%, P: 0.040% or less, S: 0.0005 to 0.020%, Cr: 20.0 to 28.0%, Ni: 4.0 to 10.0%, Mo: 2.0 to 5.0%, Al: 0.001 to 0.05%, and N: 0.06 to 0.35%, and in which the balance is Fe and incidental impurities, the dual-phase stainless steel having a microstructure containing 20 to 70% austenitic phase and 30 to 80% ferritic phase by volume, the dual-phase stainless steel having a yield strength, YS, of 448 MPa or more, and containing oxide inclusions of which oxide inclusions having an average particle diameter of 1 μm or more have a number density of 15/mm$^2$ or less, and at most 50% of the oxide inclusions having an average particle diameter of 1 μm or more are oxide inclusions containing aluminum.

[2] The dual-phase stainless steel according to [1], wherein the composition further includes, in mass %, one group or two or more groups selected from the following groups A to E, Group A: one or two selected from W: 1.5% or less, and Cu: 2.0% or less, Group B: V: 0.20% or less, Group C: one or two or more selected from Zr: 0.50% or less, B: 0.010% or less, and Nb: 0.50% or less, Group D: one or two or more selected from REM: 0.005% or less, Ca: 0.010% or less, Sn: 0.20% or less, and Mg: 0.01% or less, Group E: one or two or more selected from Ta: 0.10% or less, Co: 1.0% or less, and Sb: 1.0% or less.

[3] The dual-phase stainless steel according to [1] or [2], which has a yield strength, YS, of 655 MPa or more.

[4] A dual-phase stainless steel seamless pipe having a composition that includes, in mass %, C: 0.002 to 0.03%, Si: 0.05 to 1.0%, Mn: 0.10 to 1.5%, P: 0.040% or less, S: 0.0005 to 0.020%, Cr: 20.0 to 28.0%, Ni: 4.0 to 10.0%, Mo: 2.0 to 5.0%, Al: 0.001 to 0.05%, and N: 0.06 to 0.35%, and in which the balance is Fe and incidental impurities, the dual-phase stainless steel seamless pipe having a microstructure containing 20 to 70% austenitic phase and 30 to 80% ferritic phase by volume, the dual-phase stainless steel seamless pipe having a yield strength, YS, of 448 MPa or more, and containing oxide inclusions of which oxide inclusions having an average particle diameter of 1 μm or more have a number density of 15/mm$^2$ or less, and at most 50% of the oxide inclusions having an average particle diameter of 1 μm or more are oxide inclusions containing aluminum.

[5] The dual-phase stainless steel seamless pipe according to [4], wherein the composition further includes, in mass %, one group or two or more groups selected from the following groups A to E, Group A: one or two selected from W: 1.5% or less, and Cu: 2.0% or less, Group B: V: 0.20% or less, Group C: one or two or more selected from Zr: 0.50% or less, B: 0.010% or less, and Nb: 0.50% or less, Group D: one or two or more selected from REM: 0.005% or less, Ca: 0.010% or less, Sn: 0.20% or less, and Mg: 0.01% or less, Group E: one or two or more selected from Ta: 0.10% or less, Co: 1.0% or less, and Sb: 1.0% or less.

[6] The dual-phase stainless steel seamless pipe according to [4] or [5], which has a yield strength, YS, of 655 MPa or more.

According to aspects of the present invention, a dual-phase stainless steel and a dual-phase stainless steel seamless pipe can be provided that have high strength, high toughness, and desirable corrosion resistance.

A dual-phase stainless steel and dual-phase stainless steel seamless pipe manufactured according to aspects of the present invention are highly advantageous in industry as a stainless steel seamless pipe for oil country tubular goods.

DETAILED DESCRIPTION OF EMBODIMENTS OF THE INVENTION

An embodiment of the present invention is described below. The following descriptions are directed to a dual-phase stainless steel. However, a dual-phase stainless steel seamless pipe according to aspects of the present invention can have the same configuration as the dual-phase stainless steel.

A dual-phase stainless steel according to aspects of the present invention has a composition that includes, in mass %, C: 0.002 to 0.03%, Si: 0.05 to 1.0%, Mn: 0.10 to 1.5%, P: 0.040% or less, S: 0.0005 to 0.020%, Cr: 20.0 to 28.0%, Ni: 4.0 to 10.0%, Mo: 2.0 to 5.0%, Al: 0.001 to 0.05%, and N: 0.06 to 0.35%, and in which the balance is Fe and incidental impurities, the dual-phase stainless steel having a microstructure containing 20 to 70% austenitic phase and 30 to 80% ferritic phase by volume, the dual-phase stainless steel having a yield strength, YS, of 448 MPa or more, and containing oxide inclusions of which oxide inclusions having an average particle diameter of 1 μm or more have a number density of $15/mm^2$ or less, and at most 50% of the oxide inclusions having an average particle diameter of 1 μm or more are oxide inclusions containing aluminum.

Composition of Dual-Phase Stainless Steel

The following describes the reasons for limiting the ranges of the components in the composition of a dual-phase stainless steel according to aspects of the present invention. In the following, "%" indicating the content of each component means "mass %".

C: 0.002 to 0.03%

C is an element having the effect to improve strength and low-temperature toughness by stabilizing the austenitic phase. The C content is 0.002% or more in order to achieve high strength with a yield strength, YS, of 65 ksi or more (448 MPa or more). The C content is preferably 0.005% or more. A C content of more than 0.03% causes excessive carbide precipitation in a heat treatment, and this may have adverse effects on corrosion resistance. For this reason, the C content is 0.03% or less. The C content is preferably 0.02% or less, more preferably 0.012% or less.

Si: 0.05 to 1.0%

Si is an element that acts as a deoxidizing agent. Si is contained in an amount of 0.05% or more to obtain this effect. The Si content is preferably 0.10% or more. A Si content of more than 1.0% causes excessive precipitation of intermetallic compounds in a heat treatment, and deteriorates the corrosion resistance of steel. For this reason, the Si content is 1.0% or less. The Si content is preferably 0.7% or less, more preferably 0.6% or less.

Mn: 0.10 to 1.5%

Mn is an element effective as a deoxidizing agent, as is Si. Mn also improves hot workability by fixing the incidental element sulfur in the form of a sulfide in the steel. These effects can be obtained with a Mn content of 0.10% or more. For this reason, the Mn content is 0.10% or more. The Mn content is preferably 0.15% or more, more preferably 0.20% or more. A Mn content of more than 1.5% causes decrease of hot workability, and has adverse effects on corrosion resistance. For this reason, the Mn content is 1.5% or less. The Mn content is preferably 1.0% or less, more preferably 0.5% or less.

P: 0.040% or Less

P is an element that decreases the corrosion resistance of dual-phase stainless steel, and the corrosion resistance seriously decreases with a P content of more than 0.040%. For this reason, the P content is 0.040% or less. The P content is preferably 0.020% or less. However, in order to reduce the P content to less than 0.005%, a long dephosphorization process time is required in making a molten steel, and this increases the manufacturing cost of dual-phase stainless steel. For this reason, the P content is preferably 0.005% or more.

S: 0.0005 to 0.020%

S is an element that causes decrease of hot workability in producing a dual-phase stainless steel, and causes trouble in dual-phase stainless steel production when its content exceeds 0.020%. For this reason, the S content is 0.020% or less. The S content is preferably 0.010% or less, more preferably 0.005% or less. In view of preventing an increase of manufacturing cost, the S content is 0.0005% or more.

Cr: 20.0 to 28.0%

Cr is a basic component effective for maintaining corrosion resistance and improving strength. These effects can be obtained with a Cr content of 20.0% or more. For higher strength, the Cr content is preferably 21.0% or more, more preferably 23.0% or more. A Cr content of more than 28.0% facilitates precipitation of the a phase, and deteriorates both corrosion resistance and toughness. For this reason, the Cr content is 28.0% or less. In view of toughness, the Cr content is preferably 27.0% or less.

Ni: 4.0 to 10.0%

Ni is an element contained to stabilize the austenitic phase and obtain a dual-phase structure. With a Ni content of less than 4.0%, the austenitic phase becomes unstable, and the volume fraction of ferritic phase overly increases. For this reason, the Ni content is 4.0% or more. The Ni content is preferably 4.5% or more. With a Ni content of more than 10.0%, the austenitic phase becomes predominant, and the volume fraction of austenitic phase overly increases. Because Ni is an expensive element, such a high Ni content is not desirable in terms of economy. For this reason, the Ni content is 10.0% or less. The Ni content is preferably 8.0% or less.

Mo: 2.0 to 5.0%

Mo is an element that acts to improve the corrosion resistance of dual-phase stainless steel, and contributes to preventing pitting corrosion, particularly pitting corrosion caused by $Cl^-$. This effect cannot be obtained when the Mo content is less than 2.0%. For this reason, the Mo content is 2.0% or more. The Mo content is preferably 2.5% or more. A Mo content of more than 5.0% causes precipitation of the σ phase, and decreases toughness and corrosion resistance. For this reason, the Mo content is 5.0% or less. The Mo content is preferably 4.5% or less.

Al: 0.001 to 0.05%

Al is an element that acts as a deoxidizing agent in making a molten steel used as a raw material of a dual-phase stainless steel. This effect cannot be obtained when the Al content is less than 0.001%. For this reason, the Al content is 0.001% or more. The Al content is preferably 0.005% or more. An Al content of more than 0.05% facilitates precipitation of alumina inclusions. This causes decrease of hot workability in dual-phase stainless steel production, and deteriorates toughness. For this reason, the Al content is 0.05% or less. The Al content is preferably 0.04% or less.

N: 0.06 to 0.35%

N is known as an element that improves pitting corrosion resistance, and contributes to solid solution strengthening in a typical dual-phase stainless steel. N is actively added to produce these effects, and the N content is 0.06% or more. However, in an aging heat treatment, N forms various nitrides, and decreases sulfide stress corrosion cracking resistance and sulfide stress cracking resistance under low temperatures of 80° C. and less. This becomes more notable when the N content is more than 0.35%. For this reason, the N content is 0.35% or less. The N content is preferably 0.34% or less, more preferably 0.32% or less. In order to obtain the properties desired in accordance with aspects of the present invention, the N content is preferably 0.07% or more. The N content is more preferably 0.08% or more.

The balance is Fe and incidental impurities. Oxygen (O) is an example of incidental impurities, and an O content of at most 0.01% is acceptable.

The foregoing components represent the basic components. In addition to the basic components, one group or two or more groups selected from the following groups A to E may be optionally contained in accordance with aspects of the present invention.

Group A: one or two selected from W: 1.5% or less, and Cu: 2.0% or less

Group B: V: 0.20% or less

Group C: one or two or more selected from Zr: 0.50% or less, B: 0.010% or less, and Nb: 0.50% or less Group D: one or two or more selected from REM: 0.005% or less, Ca: 0.010% or less, Sn: 0.20% or less, and Mg: 0.01% or less Group E: one or two or more selected from Ta: 0.10% or less, Co: 1.0% or less, and Sb: 1.0% or less Group A W: 1.5% or Less (including 0%)

Low-temperature toughness may decrease when W is contained in a large amount of more than 1.5%. For this reason, the W content is 1.5% or less when this element is contained. The W content is more preferably 1.2% or less. W is an element that improves sulfide stress corrosion cracking resistance and sulfide stress cracking resistance. The W content is preferably 0.02% or more to obtain this effect. The W content is more preferably 0.8% or more.

Cu: 2.0% or Less (including 0%)

Low-temperature toughness may decrease when the Cu content is more than 2.0%. For this reason, the Cu content is 2.0% or less when this element is contained. The Cu content is more preferably 1.0% or less. In an aging heat treatment, Cu precipitates into fine ε-Cu, and greatly increases strength. Cu also improves sulfide stress cracking resistance and sulfide stress corrosion cracking resistance by strengthening the protective coating and reducing entry of hydrogen into steel. The Cu content is preferably 0.1% or more to obtain these effects. The Cu content is more preferably 0.2% or more.

Group B

V: 0.20% or Less (including 0%)

Low-temperature toughness may decrease when V is contained in an amount of more than 0.20%. A high V content may cause decrease of sulfide stress cracking resistance. For this reason, the V content is 0.20% or less when this element is contained. The V content is more preferably 0.08% or less. V is also an element that improves steel strength by precipitation hardening. The V content is preferably 0.02% or more to obtain these effects. The V content is more preferably 0.04% or more.

Group C

Zr: 0.50% or Less (including 0%)

Zr, B, and Nb are useful as elements that contribute to increasing strength, and may be selectably contained as optional elements. Zr contributes to improving sulfide stress corrosion cracking resistance, in addition to increasing strength. The Zr content is preferably 0.02% or more to obtain these effects. The Zr content is more preferably 0.05% or more. Low-temperature toughness may decrease when the Zr content exceeds 0.50%. For this reason, the Zr content is 0.50% or less when this element is contained. The Zr content is more preferably 0.30% or less, even more preferably 0.20% or less.

B: 0.010% or Less (including 0%)

B is useful as an element that contributes to improving hot workability, in addition to increasing strength. The B content is preferably 0.0005% or more to obtain these effects. The B content is more preferably 0.0010% or more. Low-temperature toughness and hot workability may decrease when the B content exceeds 0.010%. For this reason, the B content is 0.010% or less when this element is contained. The B content is more preferably 0.0080% or less, even more preferably 0.0030% or less, yet more preferably 0.0025% or less.

Nb: 0.50% or Less

Nb contributes to improving sulfide stress corrosion cracking resistance, in addition to increasing strength. The Nb content is preferably 0.005% or more to obtain these effects. The Nb content is more preferably 0.01% or more. Low-temperature toughness may decrease when the Nb content exceeds 0.50%. For this reason, the Nb content is 0.50% or less when this element is contained. The Nb content is more preferably 0.20% or less.

Group D

REM: 0.005% or Less (including 0%)

REM is useful as an element that contributes to improving sulfide stress corrosion cracking resistance, and may be contained as an optional element. The REM content is preferably 0.001% or more to ensure this effect. The REM content is more preferably 0.0015% or more. A REM content of more than 0.005% can be economically disadvantageous because the effect becomes saturated, and the effect expected from the increased content may not be obtained. For this reason, the REM content is 0.005% or less when this element is contained. The REM content is more preferably 0.004% or less.

In accordance with aspects of the present invention, "REM" represents scandium (Sc; atomic number 21) and yttrium (Y; atomic number 39), and lanthanoids from lanthanum (La; atomic number 57) to lutetium (Lu; atomic number 71). In accordance with aspects of the present invention, "REM concentration" means a total content of one element or two or more elements selected from these REM elements.

Ca: 0.010% or Less (including 0%)

Ca is useful as an element that contributes to improving sulfide stress corrosion cracking resistance, and may be contained as an optional element. The Ca content is preferably 0.001% or more to provide this effect. The Ca content is more preferably 0.0015% or more. A Ca content of more than 0.010% can be economically disadvantageous because the effect becomes saturated, and the effect expected from the increased content may not be obtained. For this reason, the Ca content is 0.010% or less when this element is contained. The Ca content is more preferably 0.0080% or less, even more preferably 0.005% or less, yet more preferably 0.004% or less.

Sn: 0.20% or Less (including 0%)

Sn is useful as an element that contributes to improving sulfide stress corrosion cracking resistance, and may be contained as an optional element. The Sn content is preferably 0.05% or more to provide this effect. The Sn content is more preferably 0.09% or more. A Sn content of more than 0.20% can be economically disadvantageous because the effect becomes saturated, and the effect expected from the increased content may not be obtained. For this reason, the Sn content is 0.20% or less when this element is contained. The Sn content is more preferably 0.15% or less.

Mg: 0.01% or Less (including 0%)

Mg is useful as an element that contributes to improving sulfide stress corrosion cracking resistance, and may be contained as an optional element. A Mg content of more than 0.01% can be economically disadvantageous because the effect becomes saturated, and the effect expected from the increased content may not be obtained. For this reason, the Mg content is 0.01% or less when this element is contained. The Mg content is more preferably 0.008% or less, even more preferably 0.005% or less. The Mg content is preferably 0.0002% or more to provide the foregoing effect. The Mg content is more preferably 0.0005% or more.

Group E

Ta: 0.10% or Less (including 0%)

Ta is useful as an element that contributes to improving carbon dioxide gas corrosion resistance, sulfide stress cracking resistance, and sulfide stress corrosion cracking resistance, and may be contained as an optional element. When the Ta content is more than 0.10%, the effects become saturated, and the effect expected from the increased content may not be obtained. For this reason, the Ta content is 0.10% or less when this element is contained. The Ta content is more preferably 0.05% or less. The Ta content is preferably 0.01% or more to provide the foregoing effects. The Ta content is more preferably 0.02% or more.

Co: 1.0% or Less (including 0%)

Co is useful as an element that contributes to improving carbon dioxide gas corrosion resistance, sulfide stress cracking resistance, and sulfide stress corrosion cracking resistance, and may be contained as an optional element. When the Co content is more than 1.0%, the effects become saturated, and the effect expected from the increased content may not be obtained. For this reason, the Co content is 1.0% or less when this element is contained. The Co content is more preferably 0.5% or less, even more preferably 0.1% or less. The Co content is preferably 0.01% or more to provide the foregoing effects. The Co content is more preferably 0.02% or more.

Sb: 1.0% or Less (Including 0%)

Sb is useful as an element that contributes to improving carbon dioxide gas corrosion resistance, sulfide stress cracking resistance, and sulfide stress corrosion cracking resistance, and may be contained as an optional element. When the Sb content is more than 1.0%, the effects become saturated, and the effect expected from the increased content may not be obtained. For this reason, the Sb content is 1.0% or less when this element is contained. The Sb content is more preferably 0.5% or less, even more preferably 0.1% or less. The Sb content is preferably 0.01% or more to provide the foregoing effects. The Sb content is more preferably 0.02% or more.

Microstructure of Dual-Phase Stainless Steel

Microstructure Containing 20 to 70% Austenitic Phase and 30 to 80% Ferritic Phase by Volume A dual-phase stainless steel according to aspects of the present invention has a microstructure containing at least an austenitic phase and a ferritic phase, and may have a microstructure consisting of an austenitic phase and a ferritic phase. The volume fraction (%) of austenitic phase is 20 to 70%. The volume fraction (%) of ferritic phase is 30 to 80%. When the austenitic phase is less than 20%, at least one of low-temperature toughness, sulfide stress cracking resistance, and sulfide stress corrosion cracking resistance may decrease. The strength may decrease when the austenitic phase is more than 70%. When the ferritic phase is more than 80%, at least one of low-temperature toughness, sulfide stress cracking resistance, and sulfide stress corrosion cracking resistance may decrease. The strength may decrease when the ferritic phase is less than 30%.

The volume fractions of these phases can be controlled by adjusting the steel composition and the temperature of solution treatment. Specifically, the volume fraction of austenitic phase increases with increase of austenitic phase-forming elements (C, Mn, Ni, N, Cu, Co), or with decrease of solution treatment temperature. The volume fraction of ferritic phase increases with increase of ferritic phase-forming elements (Si, Cr, Mo, W), or with increase of solution treatment temperature.

A measurement of the volume fraction of each phase begins with taking a test specimen for microstructure observation. First, a cross section of the dual-phase stainless steel is taken to provide an observation surface (an axial cross section when the dual-phase stainless steel is a seamless steel pipe). The volume fractions of ferritic phase and austenitic phase can then be determined by observing the surface with a scanning electron microscope (SEM). Specifically, the test specimen for microstructure observation is corroded with a Vilella's solution (a reagent prepared by mixing at a ratio of 2 g of picric acid, 10 ml of hydrochloric acid, and 100 ml of ethanol), and the microstructure image is captured with a scanning electron microscope (1,000 times). From the micrograph of the microstructure, the average area percentage is calculated for the ferritic phase and the austenitic phase to determine the volume fraction (volume %) of each phase, using an image analyzer. In a captured image, the ferritic phase, which does not corrode as easily as the austenitic phase, appears white in color after binarization, whereas the more easily corroded austenitic phase appears black in the binarized image.

Oxide Inclusions

Number Density of Oxide Inclusions Having Average Particle Diameter of 1 μm or More: 15/Mm$^2$ or Less In accordance with aspects of the present invention, oxide inclusions having an average particle diameter of 1 μm or more have a number density of 15/mm$^2$ or less. Oxide inclusions having an average particle diameter of 1 μm or more dissolve in a corrosive environment, and more easily become an initiation point of pitting corrosion. In contrast, oxide inclusions having an average particle diameter of less than 1 μm do not lead to pitting corrosion because the gap formed between these particles and the matrix is small even after dissolution.

When the number density of oxide inclusions having an average particle diameter of 1 μm or more is more than 15/mm$^2$, at least one of pitting corrosion resistance, SSC resistance, and SCC resistance become undesirable. Accordingly, in accordance with aspects of the present invention, the number density of oxide inclusions having an average particle diameter of 1 μm or more is 15/mm$^2$ or less, preferably 13/mm$^2$ or less, more preferably 10/mm$^2$ or less.

Proportion of Oxide Inclusions Containing Al is 50% or Less

In accordance with aspects of the present invention, at most 50% of oxide inclusions having an average particle diameter of 1 μm or more are oxide inclusions containing aluminum.

When the proportion of Al-containing oxide inclusions is more than 50%, at least one of pitting corrosion resistance, SSC resistance, and SCC resistance become undesirable. Accordingly, the proportion of Al-containing oxide inclusions in oxide inclusions having an average particle diameter of 1 μm or more is 50% or less, preferably 48% or less, more preferably 45% or less.

For the measurement of the number density of oxide inclusions, a test specimen prepared in the same manner as for the test specimen prepared for microstructure observation is polished to mirror finish, and is observed with a SEM in 5 fields at 50 times magnification. This is followed by a composition analysis by EDX (energy-dispersive X-ray spectroscopy) in areas around the center of oxide inclusions. For analysis, the mass ratio of elements Al, Ca, Mg, S, and Mn is measured. Desirably, the measurement is performed by applying an electron beam with a sufficiently large accelerating voltage (for example, 15 kV), in order to reduce variation of analysis values. Here, it is desirable to apply an appropriate amount of current because the applied current, when too large, decreases the SEM image resolution, and, when too small, fails to produce the amount of X-ray radiation necessary for the measurement.

The average particle diameter of oxide inclusions can be obtained by measuring the major and minor axes of inclusions, and averaging the measured values (by dividing the sum of major axis and minor axis by 2).

Oxide inclusions containing at least 20 mass % Al are determined as "Al-containing oxide inclusions". Oxide inclusions having an average particle diameter of 1 μm or more are measured for number density, and the proportion of Al-containing oxide inclusions in these oxide inclusions is calculated.

In a dual-phase stainless steel according to aspects of the present invention, the number density of oxide inclusions having an average particle diameter of 1 μm or more, and the proportion of Al-containing oxide inclusions can be controlled by controlling the duration of vacuum stirring after the injection of Al in the deoxidation step of the steelmaking process.

Method of Manufacture of Dual-Phase Stainless Steel

The following describes a method for manufacturing a dual-phase stainless steel according to aspects of the present invention of when the dual-phase stainless steel is a seamless steel pipe. A dual-phase stainless steel according to aspects of the present invention is not limited to a seamless steel pipe, and is also applicable, for example, to a stainless steel sheet, and to a UOE steel pipe, an ERW steel pipe, a spiral steel pipe, and a butt-welded pipe using a stainless steel sheet.

In accordance with aspects of the present invention, a steel material, such as a billet, having the composition described above is used as a starting material (hereinafter, also referred to as "steel pipe material"). In accordance with aspects of the present invention, a method of production of a starting material is not particularly limited, and a starting material can be produced using known methods.

In a preferred method of production of a steel pipe material having the composition described above, for example, a molten steel of the foregoing composition is made using an ordinary steelmaking process such as by using a converter, and is prepared into a steel pipe material using a known method such as continuous casting or ingot casting-blooming.

In the deoxidation step of the steelmaking process, Al inclusions are separated by floating with vacuum stirring performed after Al injection, in order to reduce the amount of Al inclusions in the steel.

For sufficient float separation of inclusions, vacuum stirring is performed with a molten steel temperature of desirably 1,550° C. or more. The temperature of molten steel can be increased by, for example, blowing oxygen in the deoxidation step or in the decarburization step preceding the deoxidation step. The increased levels of oxygen in the molten steel after oxygen blowing produce $Al_2O_3$ by reacting with the aluminum introduced in the deoxidation step.

Because float separation of inclusions must sufficiently take place to achieve the desired number density of oxide inclusions and the desired proportion of Al-containing oxide inclusions, vacuum stirring is performed for at least 15 minutes after whichever is the later of oxygen blowing and Al injection.

For prevention of decrease of molten steel temperature, vacuum stirring is performed for preferably at most 60 minutes.

The steel pipe material is heated, and formed into a seamless steel pipe of the foregoing composition and the desired dimensions using a known tubing method, for example, an extrusion method such as the Eugene Sejerne method, or hot working such as the Mannesmann method.

Solution Heat Treatment

The steel pipe prepared is subjected to a solution heat treatment. Specifically, the steel pipe is heated to a heating temperature of 1,000° C. or more, and is cooled to a temperature of 300° C. or less at an average cooling rate of air cooling or faster, specifically, at an average cooling rate of 1° C./s or faster. By the heat treatment, the intermetallic compounds, carbides, nitrides, sulfides, and other precipitates formed during the tubing process or during the cooling process after tubing form solid solutions. In this way, a seamless steel pipe can be produced that has a microstructure containing the desired amounts of austenitic phase and ferritic phase.

The desired high toughness cannot be provided when the heating temperature of the solution heat treatment is less than 1,000° C. The heating temperature of the solution heat treatment is preferably 1,020° C. or more. In view of preventing an excessively high volume fraction of ferritic phase, the heating temperature of the solution heat treatment is 1,200° C. or less. The heating temperature of the solution heat treatment is preferably 1,150° C. or less, more preferably 1,130° C. or less. In view of providing a uniform temperature in the material, it is preferable in accordance with aspects of the present invention to retain the heating temperature for at least 5 minutes in the solution heat treatment. Preferably, the heating temperature is retained for at most 210 minutes in the solution heat treatment.

When the average cooling rate of solution heat treatment is less than 1° C./s, intermetallic compounds such as the σ phase and χ phase precipitate during the cooling process, and the low-temperature toughness and corrosion resistance seriously decrease. The upper limit of average cooling rate is not particularly limited. The cooling rate of cooling in the solution heat treatment is preferably 2° C./s or more.

Cold Working

For improvement of yield strength, the material may be subjected to cold drawing, cold pilgering, or cold diameter reduction skew rolling using opposing rolls, in order to introduce strain and increase strength. Preferably, the material is subjected to diameter reduction rolling. The skew rolling machine used for diameter reduction rolling may be a two-roll or three-roll skew rolling mill having barrel-shaped rolls. The tilt angle, cross angle, and roll gap can be adjusted in diameter reduction rolling. Diameter reduction rolling may be carried out at high temperature to reduce deformation resistance. Specifically, the work temperature for strengthening is desirably confined in a temperature range of 25 to 600° C., excluding the 460 to 490° C. region where stainless steel undergoes embrittlement.

Cold working may be followed by an aging heat treatment to improve yield strength by aging hardening. When the aging heat treatment temperature is above 700° C., intermetallic compounds such as the σ phase and χ phase precipitate, and the low-temperature toughness and corrosion resistance seriously decrease. For this reason, the aging heat treatment temperature is preferably 700° C. or less.

Though the descriptions above are directed to a dual-phase stainless steel according to aspects of the present invention, the configuration described for the dual-phase stainless steel above is applicable to a dual-phase stainless steel seamless pipe according to aspects of the present invention.

According to aspects of the present invention, a dual-phase stainless steel and a dual-phase stainless steel seamless pipe can be provided that have high toughness and desirable corrosion resistance, in addition to high strength with a yield strength, YS, of 65 ksi (448 MPa) or more, preferably 95 ksi (655 MPa) or more.

EXAMPLES

The following describes Examples of the present invention. It is to be noted, however, that the present invention is not limited to the following Examples.

A molten steel of the composition shown in Table 1 was made using a converter. The number of oxide inclusions, and the composition were adjusted by varying the duration of vacuum stirring of the aluminum killed steel as shown in Table 2.

After casting a billet (steel pipe material) by continuous casting, the steel pipe material was heated to 1,150 to 1,250° C., and hot worked with a heating model seamless rolling mill. This produced a seamless steel pipe having an outside diameter of 62 mm and a wall thickness of 7 mm, or a seamless steel pipe having an outside diameter of 131 mm and a wall thickness of 25 mm.

The obtained seamless steel pipe was air cooled, and was subjected to a solution heat treatment for 30 minutes at the temperature shown in Table 2.

The solution heat treatment was performed at an average cooling rate of 2° C./s.

For work strengthening, some of the steel pipes after the solution heat treatment were subjected to diameter reduction rolling or cold pilgering. The diameter reduction rolling was performed for steel pipes having an outside diameter of 62 mm and a wall thickness of 7 mm, and the cold pilgering was performed for seamless steel pipes having an outside diameter of 131 mm and a wall thickness of 25 mm.

The diameter reduction rolling used a two-roll skew rolling mill (see "2 roll" in Table 2) or three-roll skew rolling mill (see "3 roll" in Table 2) that had barrel-shaped rolls with a feed-side face angle of 2.5° and a discharge-side face angle of 3.0° for a tilt angle of 0° and a cross angle of 0°. For diameter reduction rolling, the tilt angle was adjusted to 6° and the cross angle to 0°, and the roll gap was set at 56 mm. For cold working, cold pilgering was performed at an area reduction of 70% (see "Cold Pilger" in Table 2). Some steel pipes were rolled at high temperature (see "Work strengthening temperature" in Table 2) to reduce deformation resistance. The work strengthening temperature was confined in a temperature range of 25 to 600° C.; specifically, the rolling was performed at 25° C. or 500° C., excluding the 460 to 490° C. region where stainless undergoes embrittlement.

Some of the steel pipes (steel pipes with the heating temperatures specified for aging heat treatment in Table 2) were subjected to an aging heat treatment after rolling.

A test specimen for microstructure observation was taken from the seamless steel pipe finally obtained, and was observed for quantitative evaluation of microstructure. The test specimen was also evaluated by conducting a tensile test, a Charpy impact test, a corrosion test, a sulfide stress cracking resistance test (SSC resistance test), and a sulfide stress corrosion cracking resistance test (SCC resistance test), as follows. The results of these tests are presented in Table 2.

(1) Measurement of Volume Fraction (Volume %) of Phases in Microstructure of Steel Pipe A test specimen for microstructure observation was taken from the heat-treated seamless steel pipe in such a direction that the test specimen had an axial cross section exposed for observation. The volume fractions of ferritic phase and austenitic phase were determined by observing the exposed surface with a scanning electron microscope. Specifically, the test specimen for microstructure observation was corroded with a Vilella's solution (a reagent prepared by mixing at a ratio of 2 g of picric acid, 10 ml of hydrochloric acid, and 100 ml of ethanol), and the microstructure image was captured with a scanning electron microscope (SEM, 1,000 times). From the micrograph of the microstructure, the average area percentage was calculated for the ferritic phase and the austenitic phase to determine the volume fraction (volume %) of each phase, using an image analyzer.

In a captured image, the ferritic phase, which does not corrode as easily as the austenitic phase, appears white in color after binarization, whereas the more easily corroded austenitic phase appears black in the binarized image. For binarization, the captured image was converted into a gray-scale image with 256 shades, and was binarized over a 600 μm×800 μm (1,920 pixels×2,560 pixels) region for measurement. The threshold of binarization was set by taking the minimum intensity between two peaks observed in a histogram with the horizontal axis representing intensity (256 shades).

(2) Measurement of Number Density of Oxide Inclusions

A test specimen prepared in the same manner as for the test specimen prepared for microstructure observation was polished to mirror finish, and was observed with a SEM in 5 fields at 50 times magnification. This was followed by a composition analysis by EDX (energy-dispersive X-ray spectroscopy) in areas around the center of oxide inclusions. For analysis, the mass ratio of elements Al, Ca, Mg, S, and Mn was measured. The measurement was performed by applying an electron beam with a sufficiently large accelerating voltage (15 kV), in order to reduce variation of analysis values.

Oxide containing at least 20 mass % Al were determined as "Al-containing oxide". Oxide inclusions having an average particle diameter of 1 μm or more were measured for number density ("Density of inclusions per $mm^2$" in Table 2), and the proportion of Al-containing oxide inclusions in these oxide inclusions was calculated ("Proportion of Al-containing oxide (%)" in Table 2). The average particle diameter of oxide inclusions was obtained by measuring the major and minor axes of inclusions, and averaging the measured values.

(3) Tensile Test

From the seamless steel pipe after the heat treatment, an arc-shaped tensile test specimen meeting the API standards was taken in compliance with the API-5CT standards. Here, the specimen was taken in such a direction that the tensile direction was along the pipe axis. The test specimen was tested in a tensile test conducted in compliance with the API standards to measure yield strength YS (MPa) and tensile strength TS (MPa) as tensile properties.

(4) Charpy Impact Test

From the seamless steel pipe after the heat treatment, a V-notch test specimen (5-mm thick) of a length along the pipe axis was taken from the center of the wall thickness, in compliance with the ISO 11960 standards. The test specimen was measured for absorption energy $vE_{-10}$ (J) in a Charpy impact test conducted at a test temperature of −10° C. The measurement was carried out for three test specimens taken from each steel pipe, and an arithmetic mean value from the three test specimens was calculated after the Charpy impact test. The results are presented in Table 2.

(5) Corrosion Test (Carbon Dioxide Gas Corrosion Resistance Test)

The seamless steel pipe after the heat treatment was machined into a corrosion test specimen measuring 3 mm in thickness, 30 mm in width, and 40 mm in length. The test specimen was then evaluated for carbon dioxide gas corrosion resistance by conducting a corrosion test.

For corrosion test, the test specimen was immersed in a test solution (a 20 mass % NaCl aqueous solution; a liquid temperature of 200° C.; an atmosphere of 3.0 MPa $CO_2$) kept in an autoclave for 14 days (336 hours) so as to measure the mass, and the corrosion rate was determined by calculating a reduction in the mass of the test specimen measured before and after the corrosion test. Separately, the test specimen after the corrosion test was observed for the presence or absence of surface pitting corrosion, using a loupe at 10 times magnification. Pitting corrosion was determined as being present when an assumed circle of pitting corrosion had a diameter of 0.2 mm or more. In accordance with aspects of the present invention, the steel pipe was determined as having passed the test when the corrosion rate was 0.125 mm/y or less and there was no pitting corrosion. In Table 2, the open circle (o) means pitting corrosion was absent, and the cross (x) means pitting corrosion was present.

(6) Sulfide Stress Cracking Resistance Test (SSC Resistance Test)

A round-rod test specimen (diameter Ø=6.4 mm) was prepared by machining the seamless steel pipe after the heat treatment, in compliance with NACE TM0177, Method A. The test specimen was then subjected to an SSC resistance test.

In the SSC resistance test, the test specimen was immersed in a test solution (a 20 mass % NaCl aqueous solution; a liquid temperature of 25° C.; an atmosphere of 0.03 MPa $H_2S$ and 0.07 MPa $CO_2$) having an adjusted pH of 3.5 by addition of acetic acid and sodium acetate, and was kept in the solution for 720 hours under an applied stress 90% of the yield stress. The tested specimen was then visually observed for the presence or absence of cracking. Separately, the tested specimen was observed for the presence or absence of surface pitting corrosion, using a loupe at 10 times magnification. In accordance with aspects of the present invention, the test specimen was determined as having passed the test when it did not have a crack and there was no pitting corrosion after the test. In Table 2, the open circle (o) means cracking and pitting corrosion were absent, and the cross (x) means cracking and/or pitting corrosion were present.

(7) Sulfide Stress Corrosion Cracking Resistance Test (SCC Resistance Test)

A 4-point bending test specimen measuring 3 mm in thickness, 15 mm in width, and 115 mm in length was prepared by machining the seamless steel pipe after the heat treatment. The test specimen was then subjected to an SCC resistance test.

For the SCC resistance test, the test specimen was immersed in a test solution (a 10 mass % NaCl aqueous solution; a liquid temperature of 80° C.; an atmosphere of 35 kPa $H_2S$ and 2 MPa $CO_2$) kept in an autoclave, and was kept in the solution for 720 hours under an applied stress 100% of the yield stress. The tested specimen was then visually observed for the presence or absence of surface cracking. Separately, the tested specimen was observed for the presence or absence of surface pitting corrosion, using a loupe at 10 times magnification. In accordance with aspects of the present invention, the test specimen was determined as having passed the test when it did not have a crack and there was no pitting corrosion after the test. In Table 2, the open circle (o) means cracking and pitting corrosion were absent, and the cross (x) means cracking and/or pitting corrosion were present.

TABLE 1

| Steel | Composition (mass %) | | | | | | | | | | |
|---|---|---|---|---|---|---|---|---|---|---|---|
| No. | C | Si | Mn | P | S | Cr | Ni | Mo | Al | N | Others |
| A | 0.014 | 0.46 | 0.38 | 0.012 | 0.0013 | 22.2 | 4.8 | 3.3 | 0.015 | 0.11 | Ca: 0.0015, Co: 0.066 |
| B | 0.016 | 0.49 | 0.53 | 0.011 | 0.0015 | 22.6 | 6.3 | 3.1 | 0.047 | 0.09 | REM: 0.0028, Sb: 0.041 |
| C | 0.021 | 0.23 | 0.48 | 0.014 | 0.0009 | 25.4 | 6.5 | 3.4 | 0.021 | 0.13 | Cu: 0.4, B: 0.0016 |
| D | 0.016 | 0.25 | 0.76 | 0.011 | 0.0008 | 25.7 | 6.0 | 3.7 | 0.028 | 0.27 | W: 0.45, Cu: 0.6, Ca: 0.0046 |
| E | 0.009 | 0.53 | 0.59 | 0.013 | 0.0011 | 25.7 | 6.6 | 3.6 | 0.018 | 0.23 | V: 0.045, Mg: 0.0065 |
| F | 0.007 | 0.06 | 0.12 | 0.010 | 0.0018 | 24.8 | 6.2 | 3.3 | 0.026 | 0.24 | W: 0.90, Cu: 0.6, Sn: 0.14 |
| G | 0.007 | 0.06 | 0.12 | 0.010 | 0.0018 | 27.3 | 6.9 | 3.3 | 0.011 | 0.32 | W: 0.88, Zr: 0.25, Ta: 0.032 |
| H | 0.015 | 0.22 | 0.78 | 0.013 | 0.0009 | 25.7 | 5.8 | 3.4 | 0.025 | 0.12 | — |
| I | 0.023 | 0.48 | 0.85 | 0.015 | 0.0013 | 26.6 | 3.1 | 2.4 | 0.015 | 0.16 | — |
| J | 0.066 | 0.59 | 0.23 | 0.016 | 0.0016 | 22.7 | 6.2 | 3.3 | 0.006 | 0.25 | — |
| K | 0.016 | 0.49 | 0.39 | 0.013 | 0.0009 | 25.5 | 6.3 | 4.0 | 0.016 | 0.05 | — |
| L | 0.016 | 0.56 | 1.57 | 0.011 | 0.0006 | 23.0 | 6.4 | 2.2 | 0.026 | 0.16 | — |
| M | 0.013 | 1.13 | 0.99 | 0.010 | 0.0006 | 22.5 | 6.3 | 2.8 | 0.018 | 0.18 | — |
| N | 0.023 | 0.49 | 0.11 | 0.016 | 0.0015 | 29.8 | 4.8 | 2.9 | 0.013 | 0.15 | — |
| O | 0.020 | 0.29 | 0.80 | 0.015 | 0.0013 | 24.5 | 10.9 | 3.4 | 0.024 | 0.16 | — |
| P | 0.013 | 0.27 | 0.43 | 0.013 | 0.0013 | 25.5 | 7.0 | 5.5 | 0.019 | 0.09 | — |
| Q | 0.015 | 0.23 | 0.16 | 0.012 | 0.0013 | 23.1 | 5.7 | 2.9 | 0.015 | 0.11 | Cu: 2.7 |
| R | 0.013 | 0.23 | 0.45 | 0.018 | 0.0007 | 26.2 | 6.6 | 2.9 | 0.064 | 0.16 | — |
| S | 0.012 | 0.15 | 0.55 | 0.012 | 0.0012 | 23.5 | 6.1 | 1.7 | 0.015 | 0.18 | — |
| T | 0.012 | 0.35 | 0.46 | 0.016 | 0.0014 | 22.4 | 5.1 | 3.2 | 0.026 | 0.13 | — |
| U | 0.023 | 0.26 | 0.51 | 0.015 | 0.0009 | 25.1 | 6.6 | 3.6 | 0.041 | 0.15 | — |
| V | 0.014 | 0.21 | 1.26 | 0.013 | 0.0011 | 22.5 | 5.0 | 3.4 | 0.019 | 0.15 | Cu: 0.8, Nb: 0.015 |
| W | 0.019 | 0.35 | 0.49 | 0.011 | 0.0011 | 22.7 | 5.1 | 3.1 | 0.022 | 0.16 | B: 0.0063 |
| X | 0.016 | 0.32 | 0.74 | 0.013 | 0.0016 | 25.4 | 6.1 | 3.4 | 0.016 | 0.21 | W: 1.1, Ca: 0.0072 |
| Y | 0.015 | 0.22 | 0.55 | 0.016 | 0.0009 | 22.2 | 5.1 | 3.3 | 0.018 | 0.17 | Nb: 0.764 |
| Z | 0.007 | 0.34 | 0.46 | 0.015 | 0.0007 | 22.9 | 5.5 | 3.2 | 0.011 | 0.15 | V: 0.067, B: 0.0381 |

*The balance except for the above-components is Fe and incidental impurities.

*Underline means outside of the range of the present invention.

TABLE 2

| Steel Pipe No. | Steel No. | Steelmaking process: Duration of vacuum stirring (min) | Solution heat treatment Heating Temp. (° C.) | Work strengthening: Method of work strength-ening | Work strength-ening temperature (°C) | Aging heat treatment Heating temp. (° C.) | Microstructure: Volume fraction of ferritic phase (%) | Microstructure: Volume fraction of austenitic phase (%) | Microstructure: Density of oxide inclusions with average particle diameter of 1 μm or more (per mm$^2$) | Microstructure: Proportion of Al-containing oxide (%) | Tensile properties: Yield strength YS (MPa) | Tensile properties: Tensile strength TS (MPa) | Toughness Absorption energy vE-$_{10}$ (J) | Corrosion test: Corrosion rate (mm/y) | Corrosion test: Presence or absence of corrosion | SSC resistance test: Presence or absence of pitting corrosion | SSC resistance test: Presence or absence of pitting corrosion | Remarks |
|---|---|---|---|---|---|---|---|---|---|---|---|---|---|---|---|---|---|---|
| 1 | A | 20 | 1050 | 2 roll | 25 | — | 58 | 42 | 11.2 | 42.5 | 786 | 974 | 81 | 0.010 | ○ | ○ | ○ | PE |
| 2 | A | 20 | 1050 | 3 roll | 25 | — | 59 | 41 | 10.5 | 41.2 | 794 | 965 | 72 | 0.010 | ○ | ○ | ○ | PE |
| 3 | A | 20 | 1050 | Cold Pilger | 25 | — | 60 | 40 | 10.7 | 32.6 | 788 | 956 | 86 | 0.010 | ○ | ○ | ○ | PE |
| 4 | A | 20 | 1050 | 2 roll | 500 | — | 59 | 41 | 11.8 | 33.8 | 801 | 988 | 83 | 0.010 | ○ | ○ | ○ | PE |
| 5 | A | 20 | 1050 | 3 roll | 500 | — | 61 | 39 | 9.2 | 34.6 | 805 | 967 | 76 | 0.010 | ○ | ○ | ○ | PE |
| 6 | A | 20 | 1050 | 3 roll | 25 | 180 | 56 | 44 | 8.8 | 43.9 | 801 | 945 | 77 | 0.010 | ○ | ○ | ○ | PE |
| 7 | A | 20 | 1050 | 3 roll | 25 | 390 | 58 | 42 | 10.2 | 47.0 | 806 | 934 | 83 | 0.010 | ○ | ○ | ○ | PE |
| 8 | A | 20 | 1050 | 3 roll | 25 | 510 | 56 | 44 | 9.5 | 31.0 | 811 | 960 | 89 | 0.010 | ○ | ○ | ○ | PE |
| 9 | A | 20 | 1050 | 3 roll | 25 | 700 | 59 | 41 | 9.2 | 43.5 | 806 | 968 | 79 | 0.010 | ○ | ○ | ○ | PE |
| 10 | B | 20 | 1070 | 2 roll | 25 | — | 50 | 50 | 6.4 | 31.0 | 883 | 1084 | 68 | 0.010 | ○ | ○ | ○ | PE |
| 11 | B | 20 | 1070 | 3 roll | 25 | — | 51 | 49 | 7.9 | 38.2 | 885 | 1081 | 69 | 0.010 | ○ | ○ | ○ | PE |
| 13 | C | 20 | 1100 | 3 roll | 25 | — | 53 | 47 | 5.8 | 24.5 | 891 | 1098 | 68 | 0.010 | ○ | ○ | ○ | PE |
| 14 | D | 20 | 1100 | 2 roll | 25 | — | 42 | 58 | 10.3 | 23.5 | 894 | 1102 | 59 | 0.010 | ○ | ○ | ○ | PE |
| 15 | E | 20 | 1100 | 2 roll | 25 | — | 46 | 54 | 9.5 | 31.2 | 865 | 1076 | 49 | 0.010 | ○ | ○ | ○ | PE |
| 16 | F | 20 | 1100 | 2 roll | 25 | — | 41 | 59 | 12.4 | 45.4 | 864 | 1034 | 65 | 0.010 | ○ | ○ | ○ | PE |
| 17 | G | 20 | 1070 | 3 roll | 25 | — | 35 | 65 | 6.8 | 21.8 | 813 | 1123 | 78 | 0.010 | ○ | ○ | ○ | PE |
| 18 | H | 20 | 1070 | 2 roll | 25 | — | 44 | 56 | 9.7 | 23.2 | 870 | 1078 | 70 | 0.010 | ○ | ○ | ○ | PE |
| 19 | I | 20 | 1070 | 2 roll | 25 | 180 | 84 | 16 | 9.6 | 38.0 | 889 | 1035 | 5 | 0.010 | ○ | ○ | ○ | CE |
| 20 | J | 20 | 1070 | 2 roll | 25 | — | 7 | 93 | 5.9 | 42.3 | 661 | 895 | 178 | 0.010 | ○ | x | x | CE |
| 21 | K | 20 | 1070 | 3 roll | 25 | — | 76 | 24 | 8.8 | 41.8 | 876 | 1055 | 56 | 0.041 | x | ○ | ○ | CE |
| 22 | L | 20 | 1070 | 3 roll | 25 | — | 33 | 67 | 12.1 | 24.5 | 799 | 1013 | 93 | 0.010 | ○ | x | x | CE |
| 23 | M | 20 | 1070 | 3 roll | 25 | — | 60 | 40 | 10.2 | 33.8 | 772 | 1008 | 96 | 0.010 | ○ | x | x | CE |
| 26 | P | 20 | 1070 | 2 roll | 25 | — | 81 | 19 | 10.6 | 33.3 | 872 | 1046 | 4 | 0.010 | ○ | x | x | CE |
| 27 | Q | 20 | 1070 | 2 roll | 25 | — | 37 | 63 | 11.7 | 40.6 | 851 | 1043 | 5 | 0.010 | ○ | ○ | ○ | CE |
| 28 | R | 20 | 1070 | 2 roll | 25 | — | 53 | 47 | 12.6 | 21.5 | 876 | 1075 | 5 | 0.010 | ○ | ○ | ○ | CE |
| 29 | S | 20 | 1070 | 3 roll | 25 | — | 41 | 59 | 9.4 | 30.4 | 886 | 1095 | 60 | 0.026 | x | x | x | CE |
| 30 | T | 5 | 1070 | 3 roll | 25 | — | 52 | 48 | 15.8 | 51.8 | 827 | 1035 | 73 | 0.010 | ○ | x | x | CE |
| 32 | U | 10 | 1100 | 2 roll | 25 | — | 49 | 51 | 16.5 | 58.2 | 870 | 1078 | 69 | 0.010 | ○ | x | x | CE |
| 33 | U | 10 | 1100 | 3 roll | 25 | — | 49 | 51 | 18.6 | 62.9 | 886 | 1095 | 65 | 0.010 | ○ | x | x | CE |
| 34 | T | 5 | 1100 | 3 roll | 25 | — | 49 | 51 | 9.7 | 62.9 | 880 | 1090 | 57 | 0.010 | ○ | x | x | CE |
| 35 | U | 10 | 1100 | 3 roll | 25 | — | 49 | 51 | 18.6 | 48.9 | 891 | 1084 | 59 | 0.010 | ○ | x | x | CE |
| 36 | H | 20 | 1250 | 3 roll | 25 | — | 82 | 18 | 9.2 | 30.1 | 832 | 1095 | 7 | 0.010 | ○ | x | x | CE |
| 37 | A | 20 | 1050 | — | — | — | 48 | 52 | 11.3 | 40.5 | 490 | 735 | 241 | 0.010 | ○ | ○ | ○ | PE |
| 38 | B | 20 | 1070 | — | — | — | 52 | 48 | 6.8 | 33.5 | 496 | 746 | 249 | 0.010 | ○ | ○ | ○ | PE |
| 39 | C | 20 | 1100 | — | — | — | 55 | 45 | 7.5 | 26.5 | 547 | 795 | 221 | 0.010 | ○ | ○ | ○ | PE |
| 40 | D | 20 | 1100 | — | — | — | 41 | 59 | 12.3 | 26.0 | 576 | 824 | 198 | 0.010 | ○ | ○ | ○ | PE |
| 41 | E | 20 | 1100 | — | — | — | 46 | 54 | 8.2 | 24.9 | 594 | 843 | 201 | 0.010 | ○ | ○ | ○ | PE |
| 42 | F | 20 | 1100 | — | — | — | 43 | 57 | 11.4 | 40.2 | 588 | 842 | 206 | 0.010 | ○ | ○ | ○ | PE |

TABLE 2-continued

| Steel Pipe No. | Steel No. | Steelmaking process: Duration of vacuum stirring (min) | Solution heat treatment Heating Temp. (° C.) | Work strengthening: Method of work strength-ening | Work strengthening: Work strength-ening temperature (°C) | Aging heat treatment Heating temp. (° C.) | Microstructure: Volume fraction of ferritic phase (%) | Microstructure: Volume fraction of austenitic phase (%) | Microstructure: Density of oxide inclusions with average particle diameter of 1 μm or more (per mm$^2$) | Microstructure: Proportion of Al-containing oxide (%) | Tensile properties: Yield strength YS (MPa) | Tensile properties: Tensile strength TS (MPa) | Tensile properties: Toughness Absorption energy vE-$_{10}$ (J) | Corrosion test: Corrosion rate (mm/y) | Corrosion test: Presence or absence of corrosion | SSC resistance test: Presence or absence of pitting corrosion | SSC resistance test: Presence or absence of pitting corrosion | Remarks |
|---|---|---|---|---|---|---|---|---|---|---|---|---|---|---|---|---|---|---|
| 43 | G | 20 | 1070 | — | — | — | 32 | 68 | 8.0 | 24.5 | 622 | 864 | 181 | 0.010 | ○ | ○ | ○ | PE |
| 44 | H | 20 | 1070 | — | — | — | 46 | 54 | 9.8 | 30.2 | 539 | 791 | 190 | 0.010 | ○ | ○ | ○ | PE |
| 45 | I | 20 | 1070 | — | — | — | 85 | 15 | 12.3 | 27.3 | 605 | 820 | 5 | 0.010 | ○ | ○ | ○ | CE |
| 46 | J | 20 | 1070 | — | — | — | 8 | 92 | 7.2 | 40.0 | 527 | 782 | 21 | 0.010 | ○ | x | x | CE |
| 47 | K | 20 | 1070 | — | — | — | 74 | 26 | 6.1 | 35.6 | 521 | 780 | 220 | 0.046 | x | ○ | ○ | CE |
| 48 | L | 20 | 1070 | — | — | — | 32 | 68 | 11.0 | 28.3 | 486 | 735 | 251 | 0.010 | ○ | x | x | CE |
| 49 | M | 20 | 1070 | — | — | — | 61 | 39 | 10.8 | 39.0 | 490 | 741 | 243 | 0.010 | ○ | x | x | CE |
| 50 | N | 20 | 1070 | — | — | — | 84 | 16 | 6.3 | 41.3 | 596 | 850 | 4 | 0.010 | ○ | x | x | CE |
| 51 | O | 20 | 1070 | — | — | — | 13 | 87 | 9.1 | 30.8 | 438 | 695 | 27 | 0.010 | ○ | x | x | CE |
| 52 | P | 20 | 1070 | — | — | — | 82 | 18 | 11.5 | 39.3 | 545 | 786 | 7 | 0.010 | ○ | x | x | CE |
| 53 | Q | 20 | 1070 | — | — | — | 39 | 61 | 12.5 | 42.6 | 550 | 799 | 5 | 0.010 | ○ | ○ | ○ | CE |
| 54 | R | 20 | 1070 | — | — | — | 55 | 45 | 7.6 | 25.6 | 564 | 804 | 4 | 0.010 | ○ | ○ | ○ | CE |
| 55 | S | 20 | 1070 | — | — | — | 42 | 58 | 8.2 | 35.2 | 532 | 783 | 245 | 0.033 | x | x | x | CE |
| 56 | T | 5 | 1100 | — | — | — | 51 | 49 | 8.9 | 64.8 | 495 | 740 | 250 | 0.010 | ○ | x | x | CE |
| 57 | U | 10 | 1100 | — | — | — | 49 | 51 | 20.5 | 47.5 | 533 | 786 | 232 | 0.010 | ○ | x | x | CE |
| 58 | B | 20 | 1070 | Cold Pilger | 25 | — | 49 | 51 | 7.2 | 43.0 | 868 | 1103 | 46 | 0.010 | ○ | ○ | ○ | PE |
| 59 | N | 20 | 1070 | Cold Pilger | 25 | — | 83 | 17 | 7.2 | 46.0 | 872 | 1043 | 4 | 0.010 | ○ | x | x | CE |
| 60 | O | 20 | 1070 | Cold Pilger | 25 | — | 12 | 88 | 9.5 | 36.9 | 641 | 921 | 105 | 0.010 | ○ | x | x | CE |
| 61 | T | 5 | 1070 | Cold Pilger | 25 | — | 50 | 50 | 19.5 | 63.5 | 819 | 1035 | 104 | 0.010 | ○ | x | x | CE |
| 62 | V | 20 | 1070 | 2 roll | 25 | — | 47 | 53 | 10.5 | 31.2 | 863 | 1049 | 101 | 0.010 | ○ | ○ | ○ | PE |
| 63 | W | 20 | 1070 | 2 roll | 25 | — | 47 | 53 | 9.5 | 35.8 | 945 | 1087 | 106 | 0.010 | ○ | ○ | ○ | PE |
| 64 | X | 20 | 1070 | 2 roll | 25 | — | 48 | 52 | 9.7 | 29.4 | 803 | 993 | 97 | 0.010 | ○ | ○ | ○ | PE |
| 65 | Y | 20 | 1070 | 3 roll | 25 | — | 44 | 56 | 12.5 | 36.6 | 814 | 1021 | 32 | 0.010 | ○ | ○ | ○ | CE |
| 66 | Z | 20 | 1070 | 3 roll | 25 | — | 49 | 51 | 11.5 | 30.5 | 864 | 1045 | 29 | 0.010 | ○ | ○ | ○ | CE |

Underline means outside of the range of the present invention.

PE: Present Example

CE: Comparative Example

The dual-phase stainless steel pipes of the present examples all had high strength with a yield strength of 448 MPa or more, and high toughness with an absorption energy $vE_{-10} \geq 40$ J in the Charpy impact test. The dual-phase stainless steel pipes of the present examples also had desirable corrosion resistance (carbon dioxide gas corrosion resistance) in a high-temperature corrosive environment of 200° C. or more containing $CO_2$ and $Cl^-$. The sulfide stress cracking resistance and sulfide stress corrosion cracking resistance were also desirable as demonstrated by the absence of cracking (SSC and SCC) in a $H_2S$-containing environment. In contrast, the desired high strength or high toughness according to aspects of the present invention was not achievable, or cracking (SSC and/or SCC) occurred in a $H_2S$-containing environment in Comparative Examples that did not fall within the ranges of the present invention.

The invention claimed is:

1. A dual-phase stainless steel having a composition that consists of, in mass %, C: 0.002 to 0.03%, Si: 0.05 to 1.0%, Mn: 0.10 to 1.5%, P: 0.040% or less, S: 0.0005 to 0.020%, Cr: 20.0 to 28.0%, Ni: 4.0 to 10.0%, Mo: 2.0 to 5.0%, Al: 0.001 to 0.05%, N: 0.06 to 0.35%, and optionally, W: 1.5% or less, Cu: 2.0% or less, Zr: 0.50% or less, B: 0.010% or less, Nb: 0.50% or less, REM: 0.005% or less, Ca: 0.010% or less Sn: 0.20% or less, Mg: 0.01% or less, Ta: 0.10% or less, Co: 1.0% or less, and Sb: 1.0% or less, and in which the balance is Fe and incidental impurities, the dual-phase stainless steel having a microstructure containing 20 to 70% austenitic phase and 30 to 80% ferritic phase by volume, the dual-phase stainless steel having a yield strength, YS, of 448 MPa or more, and containing oxide inclusions of which oxide inclusions having an average particle diameter of 1 μm or more have a number density of $15/mm^2$ or less, and at most 50% of the oxide inclusions having an average particle diameter of 1 μm or more are oxide inclusions containing aluminum.

2. The dual-phase stainless steel according to claim 1, which has a yield strength, YS, of 655 MPa or more.

3. A dual-phase stainless steel seamless pipe having a composition that consists of, in mass %, C: 0.002 to 0.03%, Si: 0.05 to 1.0%, Mn: 0.10 to 1.5%, P: 0.040% or less, S: 0.0005 to 0.020%, Cr: 20.0 to 28.0%, Ni: 4.0 to 10.0%, Mo: 2.0 to 5.0%, Al: 0.001 to 0.05%, N: 0.06 to 0.35%, and optionally, W: 1.5% or less, Cu: 2.0% or less, Zr: 0.50% or less, B: 0.010% or less, Nb: 0.50% or less, REM: 0.005% or less, Ca: 0.010% or less, Sn: 0.20% or less, Mg: 0.01% or less, Ta: 0.10% or less, Co: 1.0% or less, and Sb: 1.0% or less, and in which the balance is Fe and incidental impurities, the dual-phase stainless steel seamless pipe having a microstructure containing 20 to 70% austenitic phase and 30 to 80% ferritic phase by volume, the dual-phase stainless steel seamless pipe having a yield strength, YS, of 448 MPa or more, and containing oxide inclusions of which oxide inclusions having an average particle diameter of 1 μm or more have a number density of $15/mm^2$ or less, and at most 50% of the oxide inclusions having an average particle diameter of 1 μm or more are oxide inclusions containing aluminum.

4. The dual-phase stainless steel seamless pipe according to claim 3, which has a yield strength, YS, of 655 MPa or more.

* * * * *